United States Patent [19]

Bose et al.

[11] Patent Number: 4,851,042

[45] Date of Patent: Jul. 25, 1989

[54] HARDNESS AND STRENGTH OF HEAVY ALLOYS BY ADDITION OF TANTALUM

[75] Inventors: Animesh Bose, Troy; Randall M. German, Latham, both of N.Y.

[73] Assignee: Rensselaer Polytechnic Institute, Troy, N.Y.

[21] Appl. No.: 220,515

[22] Filed: Jul. 18, 1988

Related U.S. Application Data

[63] Continuation-in-part of Ser. No. 048,703, May 12, 1987, Pat. No. 4,801,330.

[51] Int. Cl.[4] ..... C22C 32/00

[52] U.S. Cl. ..... 75/248; 419/26; 419/29; 419/38; 419/56; 419/58; 419/60; 420/430; 420/590

[58] Field of Search ..... 75/248; 419/26, 29, 419/38, 56, 58, 60; 420/430, 590

[56] References Cited

U.S. PATENT DOCUMENTS

| | | | |
|---|---|---|---|
| 2,122,403 | 7/1938 | Balke et al. | 75/248 |
| 3,888,636 | 6/1975 | Sczerzenie et al. | 75/248 |
| 3,988,118 | 10/1976 | Grierson et al. | 419/29 |
| 4,012,230 | 3/1977 | Dickinson et al. | 75/248 |

*Primary Examiner*—Stephen J. Lechert, Jr.
*Attorney, Agent, or Firm*—Notaro & Michalos

[57] ABSTRACT

A tungsten heavy alloy system is modified by replacing from 2% to 10% of the tungsten by weight with tantalum to increase the strength and hardness characteristics for the alloy. This renders the alloy particularly useful for kinetic energy penetrators.

11 Claims, 1 Drawing Sheet

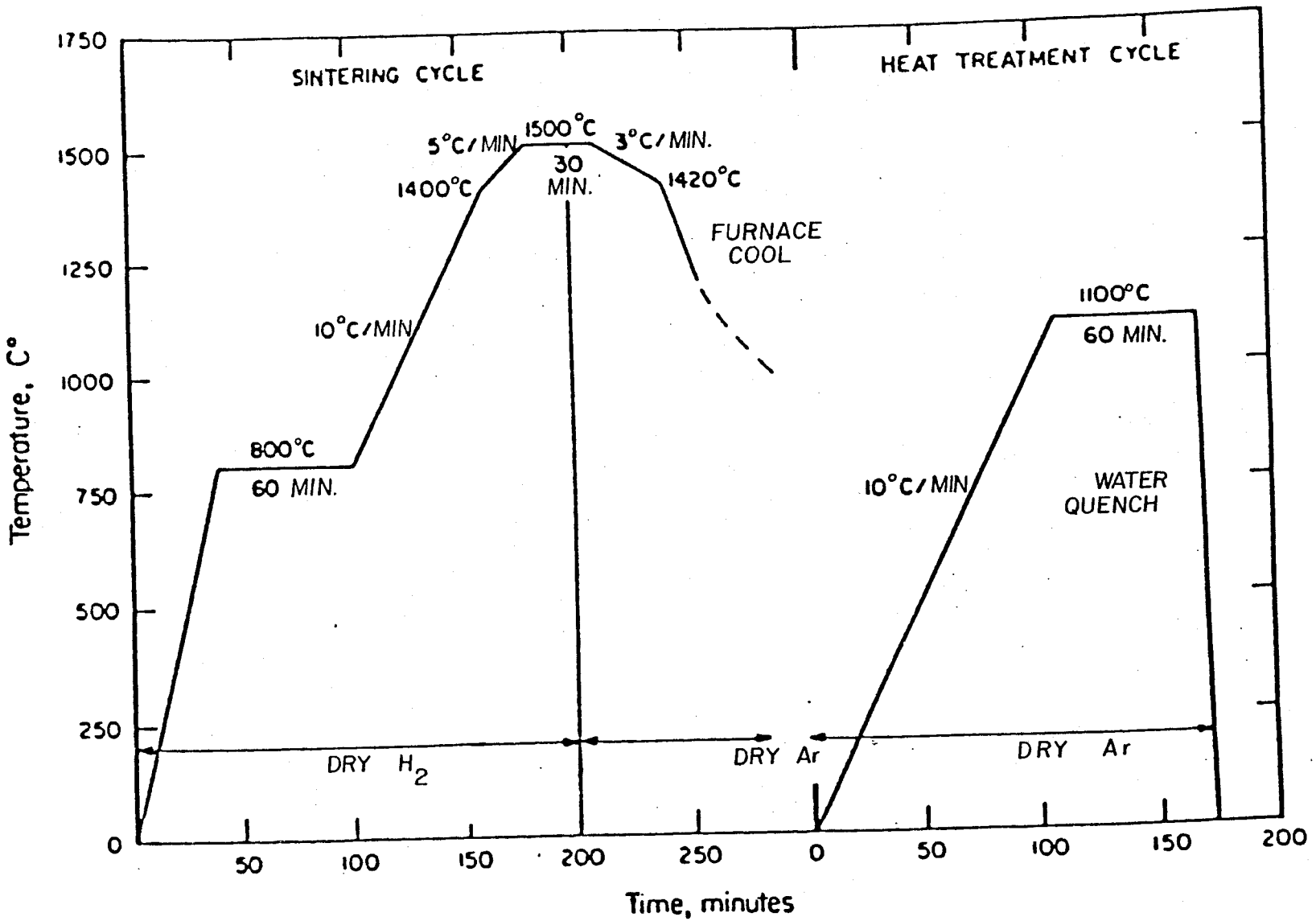
HEAT TREATMENT CYCLE
SINTERING CYCLE
1100°C
60 MIN.
WATER QUENCH
10°C/MIN
FURNACE COOL
1420°C
3°C/MIN.
1500°C
30 MIN.
5°C/MIN
1400°C
10°C/MIN
800°C
60 MIN.
DRY Ar
DRY Ar
DRY $H_2$
Temperature, C°
Time, minutes
1750
1500
1250
1000
750
500
250
0
50
100
150
200
250
200
150
100
50
0

HARDNESS AND STRENGTH OF HEAVY ALLOYS BY ADDITION OF TANTALUM

CROSS REFERENCE TO RELATED APPLICATION

This is a continuation-in-part application of Ser. No. 048,703, filed May 12, 1987 now U.S. Pat. No. 4,801,330.

FIELD AND BACKGROUND OF THE INVENTION

The present invention relates to heavy metal alloys and in particular to a tungsten alloy whose strength and hardness properties are improved by the inclusion of tantalum.

Classic tungsten heavy alloys include about 90% by weight tungsten with nickel and iron added in a ratio of about 7 to 3.

Tungsten heavy alloys have an attractive combination of properties including high density, high strength, high ductility and easy machinability. This makes tungsten alloys very useful for applications such as radiation shields, counterbalances, heavy duty electrical contacts, vibration dampers and kinetic energy penetrators. The usefulness of the alloy, in particular when used as kinetic energy penetrators, can be enhanced if its strength and hardness properties are increased. Even a relatively small increase in strength and hardness, for example 1% or 2% would be advantageous.

Some attempts have been made to improve the strength of alloys by adding cobalt, chromium, rhenium, platinum, titanium, small amounts of molybdenum and aluminum. These attempts have met with very little success however.

Rather than improving the hardness characteristics of heavy alloys, kinetic energy penetrators, especially those used for piercing heavy armor plates, have been made with depleted uranium as an important constituent. This material is, of course, highly toxic and expensive. It would, therefore, by very desirable if a heavy alloy could be developed having substantially increased hardness and strength characteristics.

SUMMARY OF THE INVENTION

According to the present invention, if from about 2% to about 10% by weight of the tungsten in a classic tungsten heavy alloy system is replaced by tantalum, the strength and hardness characteristics of the alloy are drastically improved. This improvement is particularly useful in constructing kinetic energy penetrators from the new alloy.

The new alloy is made using a sintering process at 1500° C. for 30 minutes. This results in an alloy which has much higher strength and hardness than classic tungsten alloy. The grain size of the tungsten alloy with tantalum added is also refined. The ductility of the improved alloy is lower than that for classic tungsten alloy but this is also an advantage for the fabrication of kinetic energy penetrators. The improved alloy can also be used where hard metals are needed, for example, in oil drilling bits. While the sintered density of the improved alloy is somewhat lower than for classic tungsten alloy (95% dense) the new alloy is still sufficiently dense for applications such as radiation shields.

Accordingly an object of the present invention is to provide a tungsten alloy which is doped with tantalum to improve its strength and hardness characteristics.

Another object of the present invention is to provide a method for preparing the alloy by sintering.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only FIGURE in the drawing is a graph illustrating the sintering and heating cycles employed in the present invention.

DESCRIPTION OF THE PREFERRED EMBODIMENT

An alloy prepared in accordance with the present invention has the following composition, expressed in weight percent:

85W-5Ta-7Ni-3Fe. The properties of this new alloy compared to conventional tungsten alloy with a composition of 90W-7Ni-3Fe, is shown in the table.

TABLE

| Properties | 85W—5Ta—7Ni—3Fe | 90W—7Ni—3Fe |
|---|---|---|
| Sintered density (gm/cc) | 16.2 ± 0.03 | 17.09 ± 0.03 |
| Percent theoretical density | 95 | 99.6 |
| Yield strength (MPa) | 740 ± 7 | 534 ± 11 |
| UTS (Ultimate Tensile Strength in MPa) | 1025 ± 20 | 923 ± 3 |
| Elongation (percent) | 3.3 ± 0.7 | 30.4 ± 1.6 |
| HRA (Hardness in (Rockwell A scale) | 69 ± 0.8 | 62.8 ± 0.2 |

The strength and hardness of the alloy is thus improved by adding tantalum. This is however at some cost to the density and elongation properties. Reduction and theoretical density is due to the porosity of the new alloy which in turn results from the tendency of tantalum to pick up hydrogen or other gas. In view of this, it may be advantageous to sinter the alloy in a vacuum.

It is expected that between 2% and 10% by weight tantalum would be useful in the tungsten alloy. Less than this would result in low improvements in strength and hardness while a greater percentage tantalum would excessively increase porosity.

As illustrated in the table, the UTS and HRA hardness figures are both increased by at least 10% while the yield strength is increased by over 38%. At the same time only a 4.6% reduction in theoretical density results. Even higher density may be attainable if the alloy is prepared in a vacuum.

The FIGURE illustrates details of the sintering and heat treatment used in the invention. A compact to be sintered is first prepared. This is done by placing elemental nickel and iron powder in the ration of 7:3 by weight in a standard mixer for one hour. To this premix of nickel and iron, various amounts of elemental tungsten or both elemental tungsten and tantalum are added. This final mix is then blended for one hour in the same mixer.

Following the blending of the metal powders, flat tensile bars are compacted. A compacting pressure of 275 MPa is used. During compaction, zinc stearate is used as a die wall lubricant.

Sintering is carried out in a horizontal tube furnace programmed to control the heating and cooling rates as well as the hold temperatures shown in the figure. The sintering cycle begins with a relatively rapid heating of the compact to 800° C. The temperature is then held at that level for 60 minutes in an atmosphere of dry hydrogen for the purpose of reducing the oxygen content in the compact. Those skilled in the art will appreciate that the temperature and time for this prereduction hold need not be precisely at 800° C. and 60 minutes. It can, for example, be done at somewhat higher temperatures such as 900° C. and the time can be similarly varied. After the 800° C. hold, the temperature is increased at the rate of about 10° C./min.

At about 1400° C., the heating rate is reduced to about 5° C./min. The purpose for using the slower heating rate is to provide sufficient time to allow the compact to develop full densification as liquid is formed.

When a temperature of 1500° C. is achieved, it is held for at least about 30 minutes. During the last ten minutes of the 1500° C. hold, the atmosphere is changed from dry hydrogen to dry argon gas. The purpose for doing so is to reduce hydrogen embrittlement of the alloy product which would otherwise occur. This technique permits the hydrogen to exit the system in an outward diffusion flow and we have found that is is advantageous to make the change to argon during the 1500° C. hold, or at least at a relatively high temperature.

At the end of the thirty minute hold, the temperature is reduced at the slow rate of 3° C./min. This slow rate is chosen until the temperature is below the melting point of the matrix in order to keep the formation of pores to a minimum. After solidification, the compact can be allowed to cool at a relatively fast furnace cooling rate. This can be accomplished by simply leaving the compact in place and allowing it to cool down with the furnace. After the compact has completely cooled, it is removed from the furnace and given the heat treatment shown in the figure which consists in elevating its temperature to 1100° C. and holding it there for approximately 60 minutes and then quenching the compact in water, all in an argon atmosphere. The purpose of this step is to suppress the segregation of impurities at the tungsten-matrix interfaces, thereby avoiding the embrittlement of the material.

The above described sintering and heat treatment cycle produces alloy products which have as-sintered densities of about 95% of theoretical densities.

While a specific embodiment of the invention has been showed and described in detail to illustrate the application of the principles of the invention, it will be understood that the invention may be embodied otherwise without departing from such principles.

What is claimed is:

1. A tantalum-doped heavy alloy consisting essentially of:

a major constituent of tungsten in a proportion of 80% to 88% by weight of the alloy;

a minor constituent composed of 2% to 10% by weight of tantalum; and a remaining constituent of nickel and iron.

2. The alloy of claim 1 wherein the major constituent of tungsten is in a proportion of 85% by weight the minor constituent of tantalum is in a proportion of 5% by weight, the remaining constituent of nickel and iron comprising 7% by weight nickel and 3% by weight iron.

3. A method of making a dense alloy having high strength and hardness comprising:

forming a mixture of metal powders composed of a main constituent of tungsten in a proportion of 80% to 88% by weight of the mixture and a minor constituent consisting of tantalum in a proportion of 2% to 10% by weight of the mixture, and nickel and iron in respective proportions of 7% and 3% by weight of the mixture;

compressing the mixture into a compact;

dry phase sintering the compact for at least about 30 minutes; and slow cooling the sintered compact.

4. The method of claim 3 wherein the sintering is performed in the presence of substantially only dry hydrogen gas.

5. The method of claim 3 wherein the sintering step is performed in the initial presence of substantially only dry hydrogen gas, and for about the last ten minutes, in the presence of substantially only dry argon gas.

6. The method of claim 3 wherein the sintering is performed in a vacuum.

7. The method of claim 3, including, after the slow cooling step, further cooling the compact more quickly to below 1100° C., thereafter heating the compact to 1100° C., holding the compact at 1100° C. for about one hour and thereafter water quenching the compact.

8. The method of claim 3, including forming the mixture of metal powders which consist essentially of the constituents of tungsten, tantalum, nickel and iron.

9. The method of claim 7, including forming the mixture of metal powders which consist essentially of the constituents of tungsten, tantalum, nickel and iron.

10. The method of claim 3, wherein the mixture consists essentially of 85% by weight tungsten, 5% by weight tantalum, 7% by weight nickel and 3% by weight iron.

11. The method of claim 7, wherein the mixture consists essentially of 85% by weight tungsten, 5% by weight tantalum, 7% by weight nickel and 3% by weight iron.

* * * * *